United States Patent [19]

Rahrig et al.

[11] Patent Number: 4,717,356

[45] Date of Patent: Jan. 5, 1988

[54] ELECTRICAL RECEPTACLE TERMINAL

[75] Inventors: Thomas F. Rahrig, Antwerp, Ohio; Thomas E. Hall, Fort Wayne, Ind.

[73] Assignee: United Technologies Automotive, Inc., Dearborn, Mich.

[21] Appl. No.: 850,458

[22] Filed: Apr. 10, 1986

[51] Int. Cl.[4] ..... H01R 13/58

[52] U.S. Cl. ..... 439/464; 439/275; 439/852; 439/858

[58] Field of Search ..... 339/103, 256 R, 258 R, 339/256 RT, 256 SP, 258 F, 258 P, 276 SF, 255

[56] References Cited

U.S. PATENT DOCUMENTS

| | | | |
|---|---|---|---|
| 3,192,498 | 6/1965 | Ruehlemann | 339/258 R |
| 3,229,392 | 1/1967 | Evans | 339/256 R |
| 4,068,917 | 1/1978 | Seidler | 339/258 R |
| 4,148,547 | 4/1979 | Atsuki et al. | 339/258 R |
| 4,560,231 | 12/1985 | Shirai | 339/256 R |

FOREIGN PATENT DOCUMENTS

| | | | |
|---|---|---|---|
| 0068698 | 1/1983 | European Pat. Off. | 339/258 R |
| 3231484 | 3/1983 | Fed. Rep. of Germany | 339/258 R |
| 2512283 | 3/1982 | France | 339/256 R |

*Primary Examiner*—Gil Weidenfeld
*Assistant Examiner*—David Pirlot
*Attorney, Agent, or Firm*—Stephen A. Schneeberger

[57] ABSTRACT

An electrical receptacle terminal having a longitudinal body for receiving a pin terminal includes a bifurcated beam spring forming two spring arms. The two spring arms act independently to urge an inserted pin terminal into good electrical contact with an opposing rib formed in an opposing wall. Each spring arm also includes a respective side flange which is contoured to engage the pin terminal in quadrature with the spring arms and rib. The pair of flanges have opposed faces for engaging opposite sides of the pin terminal. The spacing of the opposed faces of the flanges is normally less than the dimension of the pin terminal they engage such that they and the spring arms are resiliently spread by the pin terminal to thereby provide secure engagement. The four walls of the receptacle terminal are folded inward and rearward to form a continuous entry aperture and also to provide the spring arms.

8 Claims, 22 Drawing Figures

10
11
12
14
15
16
18
20
44
67
90
92
94
96
98

FIG. 3
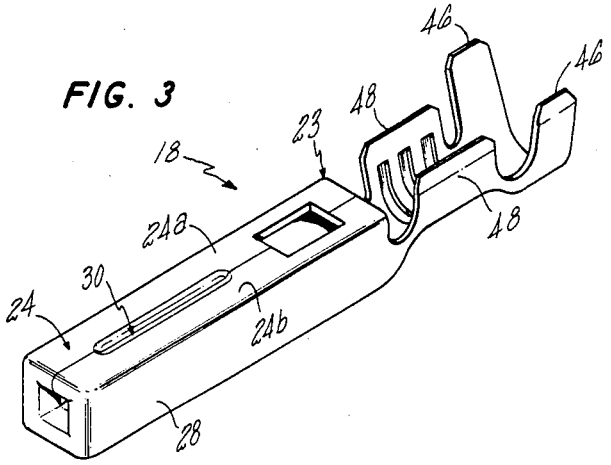
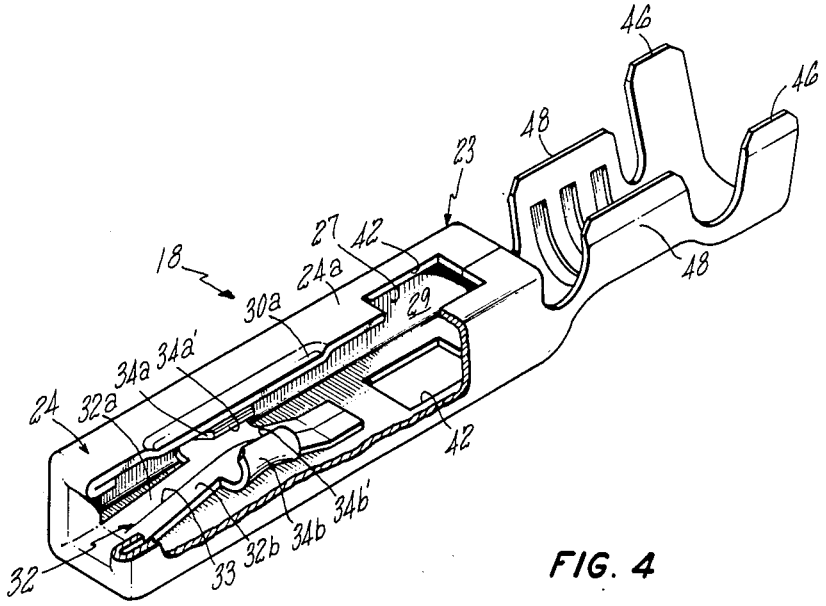
FIG. 4

FIG. 5
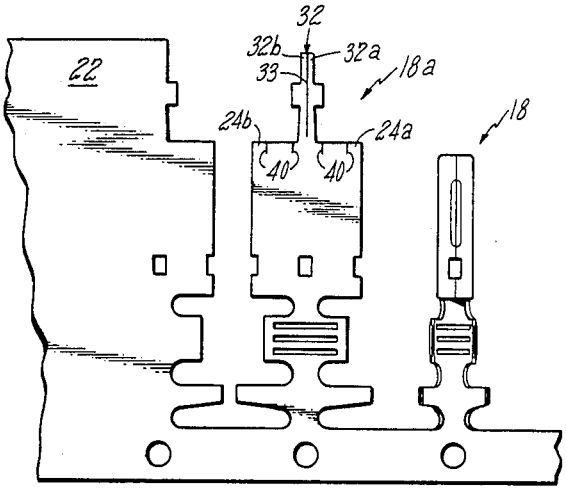
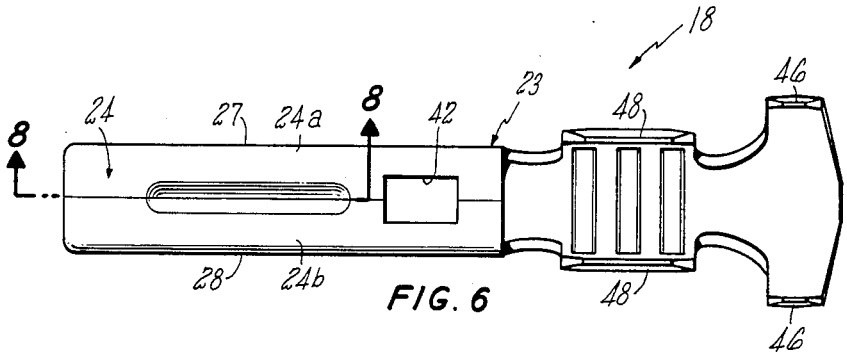
FIG. 6
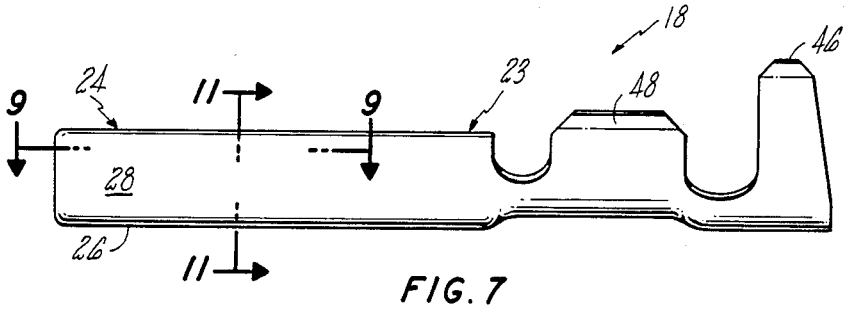
FIG. 7

FIG. 12
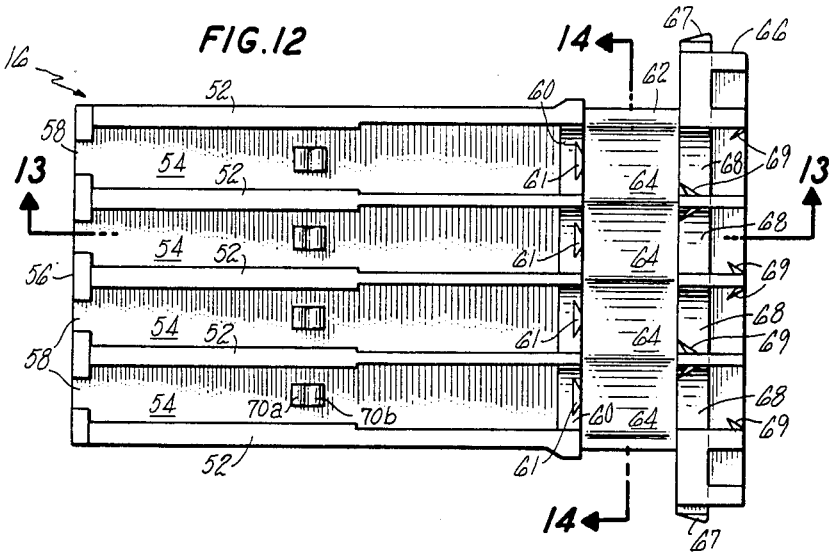
FIG. 13
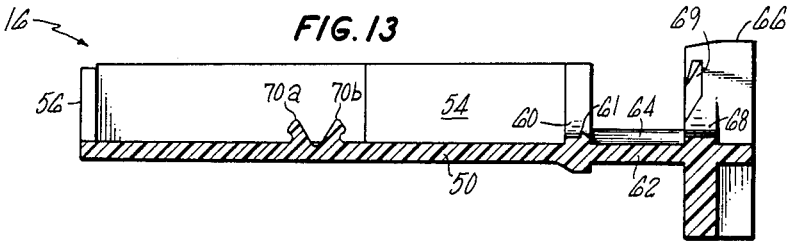
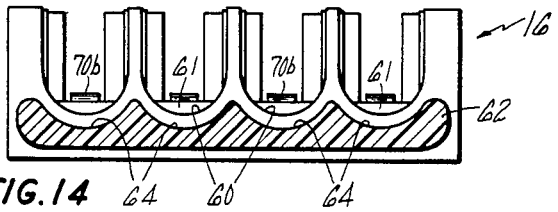
FIG. 14
FIG. 15
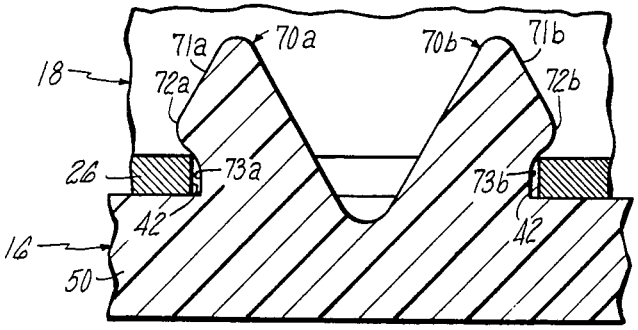

FIG. 18
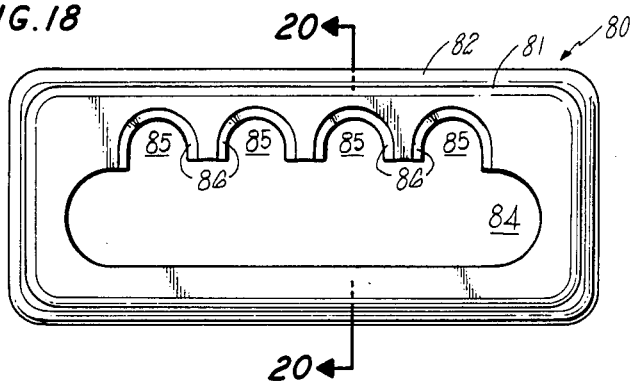
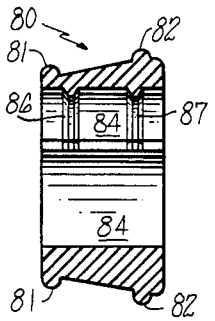
FIG. 20
FIG. 19
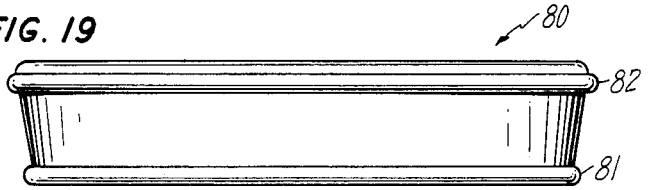
FIG. 21
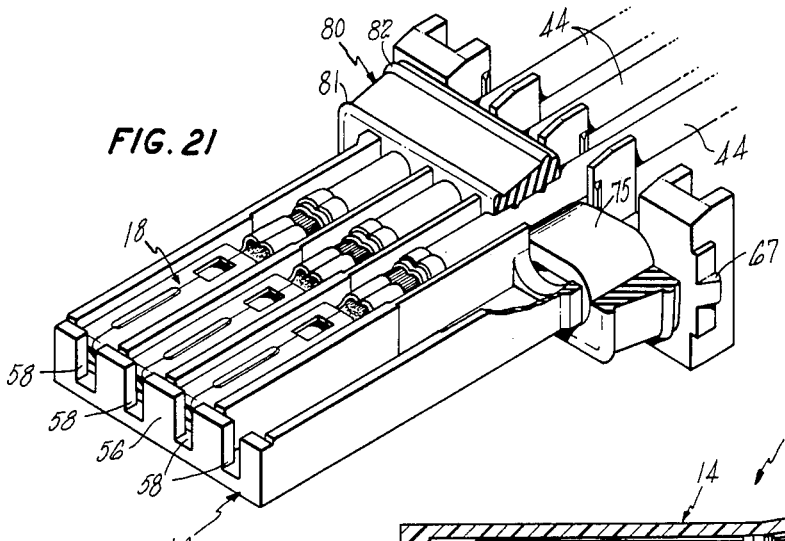
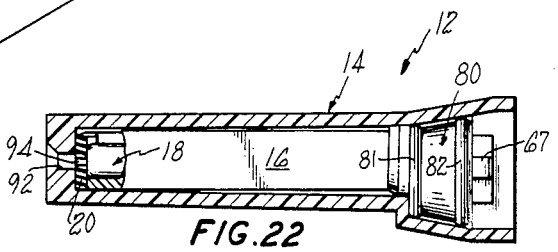
FIG. 22

ELECTRICAL RECEPTACLE TERMINAL

CROSS-REFERENCE TO RELATED PATENT APPLICATIONS

This application is related to the subject matter disclosed and claimed in patent application Ser. No. 850,459 for ARRANGEMENT FOR SECURING ELECTRICAL TERMINAL IN TERMINAL HOLDER by Thomas F. Rahrig and Thomas E. Hall, and patent application Ser. No. 850,460 for SEALED ELECTRICAL CONNECTOR ASSEMBLY by Thomas F. Rahrig and Thomas E. Hall, said applications filed on even date herewith and assigned to the same assignee.

DESCRIPTION

1. Technical Field

The invention relates to an electrical terminal and more particularly to an electrical receptacle terminal for receiving a pin terminal. More particularly still, the invention relates to a receptacle terminal of the type having internal spring contact arms.

2. Background Art

Receptacle terminals exist in a variety of configurations. U.S. Pat. No. 4,241,970 depicts a receptacle terminal of the so-called tuning fork type with tines positioned to engage a pin terminal. U.S. Pat. No. 4,007,977 discloses a connector having a plurality of terminals formed by a simple pair of opposed spring arms for contacts. Another common form for such receptacle terminals involves forming an elongated enclosure of the contact material and providing contact springs integral therewith and extending longitudinally therein. Various U.S. Patents depicting this latter type of receptacle terminal include U.S. Pat. Nos. 3,550,067; 3,711,819; 3,760,340; 3,786,401; 3,853,389; 4,076,369; 4,152,042; 4,367,006; 4,448,477; 4,531,804; 4,540,233 and 4,560,231.

Most of these patents have as one or more of their objectives the provision of good electrical contact, durability, avoidance of pin terminal misalignment, easy insertion and the like. Further when a connector employing this type of receptacle terminal is used with a pin terminal connector in an environment which subjects the connector assembly to vibration, as in an automobile, the electrical connections may deteriorate for the reasons given in the aforementioned U.S. Pat. No. 4,560,231. In an effort to obviate that problem, that patent provided a receptacle having an elongate spring therein and, thereabove, a pair of top wall tabs having downwardly projecting contact points for defining the upper portion of the receptacle. The spring has a pair of upwardly extending contact points. That configuration is intended to provide stability and durability to the electrical connection by providing six points of contact on a pin terminal, two angled upwardly and inwardly near a longitudinal midpoint on the pin, two angled downwardly and inwardly relatively toward one end of the pin, and another two angled downwardly and inwardly relatively toward the other end of the pin. Stop projections are provided to prevent misalignment of a pin.

Although the foregoing U.S. Pat. No. 4,560,231 may provide some advantages over the other prior art, it relies upon small points of contact which in turn may increase the resistance of the conductive path at the interface and which may concentrate the wear forces to too small an area. Additionally, that configuration may continue to be subject to contact intermittancy resulting from vibratory forces in the direction of the resilient contact force provided by the spring.

The U.S. Pat. No. 3,550,067 represents another similar receptacle terminal in which a pair of bowed contacts, each anchored at their opposite ends urge different portions of a blade terminal into contact with respective ones of a pair of spaced indented ribs.

Disclosure Of Invention

It is a principal object of the present invention to provide an improved receptacle terminal for receiving a pin terminal. Included in this object is the provision of a receptacle terminal which maintains good electrical contact with a pin terminal even under conditions of significant vibration.

It is a further object of the invention to provide an improved receptacle terminal which minimizes or eliminates the possibility for misalignment of a pin terminal during insertion.

In accordance with the invention there is provided an improved receptacle terminal having a longitudinal body for receiving a pin terminal and including spring means secured to the body and extending longitudinally therein in the direction of insertion of the pin terminal. The terminal includes first and second opposing wall regions, with longitudinal rib means extending inwardly from the first wall region. The spring means is intermediate the rib means and the second wall region and is split longitudinally for at least part of its length to provide first and second relatively independent spring arms. The first and second spring arms oppose the rib means for receiving the inserted terminal pin therebetween and for independently and cooperatively contacting and urging the terminal pin into contact with the rib. The spring means is integrally joined only at one end to the terminal body and is longitudinally split from the other end thereof to provide the spring arms.

The first and second spring arms include respective first and second flanges extending therefrom. The flanges are contoured to provide respective, substantially opposing surfaces for receiving the terminal pin therebetween. The spacing between the flanges is less than the width of the pin terminal so as to resiliently engage the pin terminal. The forward edges of the flanges are rearwardly inclined to facilitate entry of the pin terminal.

The terminal includes side walls connecting the first and second opposing walls and is generally rectangular. The forward ends of the several walls are folded inward and rearward to cumulatively define a substantially continuous entry aperture at the front of the terminal. That entry aperture is inwardly inclined to facilitate entry. One of the folded walls provides the spring means.

BRIEF DESCRIPTION OF THE DRAWINGS

FIG. 3 is a perspective view of a receptacle terminal;

FIG. 4 is a perspective view of the terminal of FIG. 3, partly broken away to reveal the structure for supporting a pin terminal;

FIG. 5 is a plan view of several stages of the blank from which the receptacle terminal of FIGS. 3 and 4 is formed;

FIG. 6 is a plan view of the terminal of FIG. 3;

FIG. 7 is a side elevation view of the terminal of FIG. 6;

FIG. 12 is a top plan view of the terminal holder of the assembly of FIG. 2;

FIG. 13 is a sectional view of the terminal holder of FIG. 12, taken along line 13—13 thereof and showing a terminal-locking element;

FIG. 14 is a sectional view of the terminal holder of FIG. 12 taken along line 14—14 thereof;

FIG. 15 is an enlarged partial view of the terminal holder of FIG. 13 showing the terminal locking element in greater detail and including a terminal disposed thereat;

FIG. 18 is a front view of a second seal;

FIG. 19 is a top view of the seal of FIG. 18;

FIG. 20 is a sectional view of the seal of FIG. 18 taken along line 20—20 thereof;

FIG. 21 is a perspective view, partly broken away, of a terminal holder and terminals following the installation of the first and second seals; and FIG. 22 is a side view of the receptacle terminal assembly of FIG. 1, partly broken away and partly in section to further illustrate the sealing arrangement.

BEST MODE FOR CARRYING OUT THE INVENTION

Figures 1, 2:
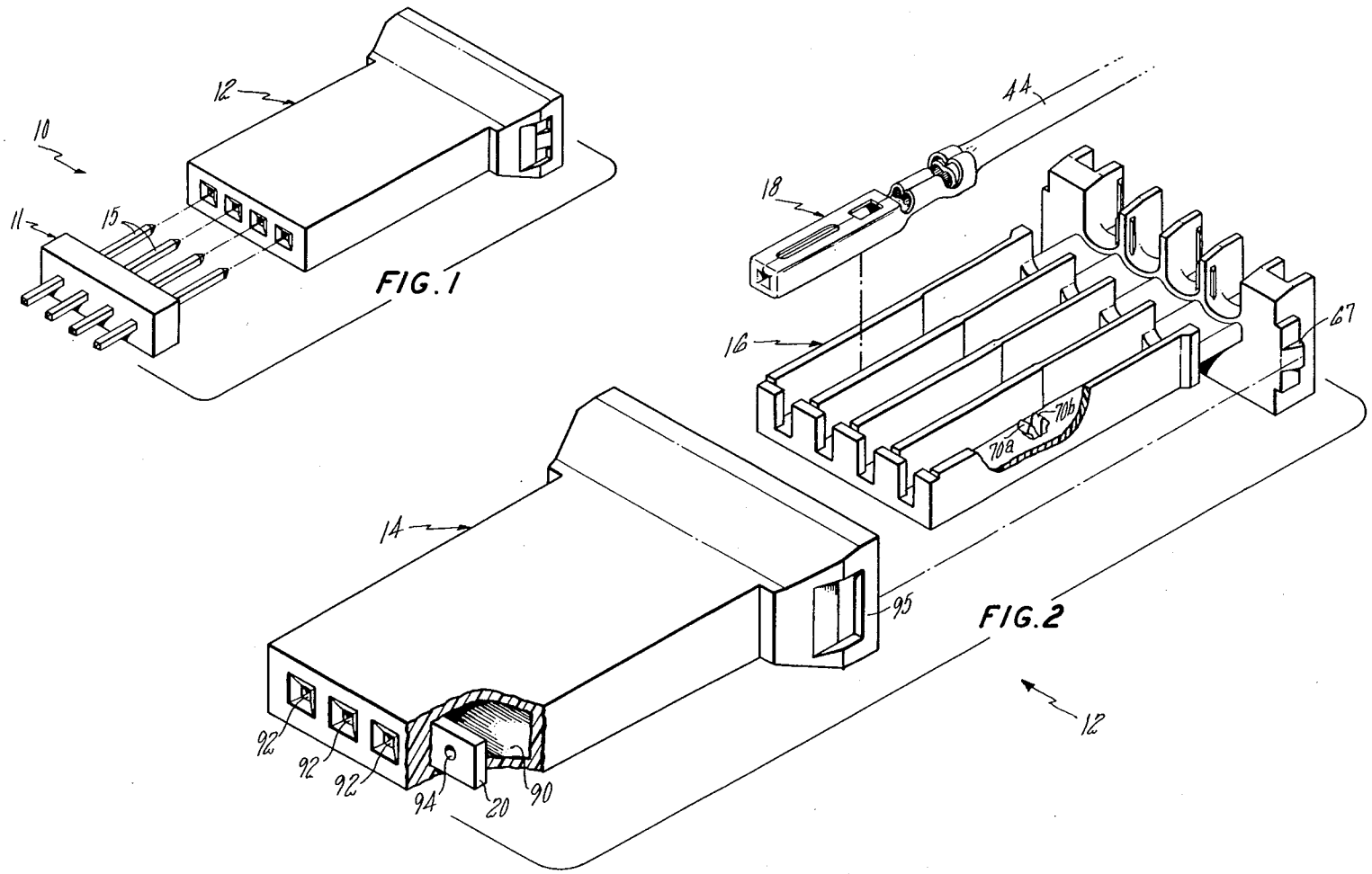
FIG. 1 is an exploded perspective view of a connector system, including a receptacle terminal connector assembly in accordance with the invention.
FIG. 2 is an exploded perspective view of part of the receptacle terminal connector assembly, showing the connector housing, terminal holder, a terminal and a face seal.
Figure 8:
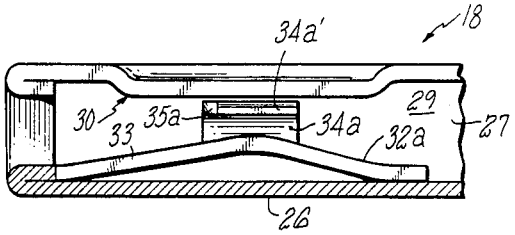
FIG. 8 is a sectional view of the terminal of FIG. 6, taken along line 8—8 thereof.
Figure 9:
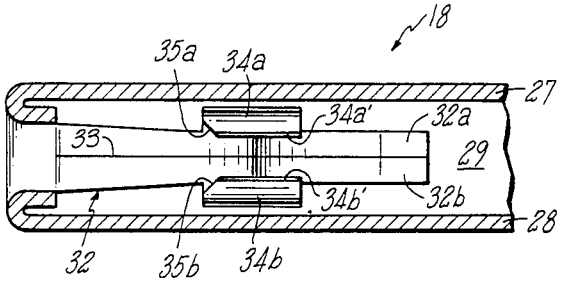
FIG. 9 is a sectional view of the terminal of FIG. 7, taken along line 9—9 thereof.
Figure 10:
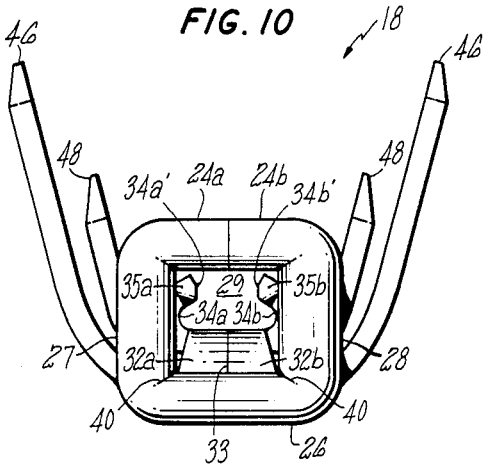
FIG. 10 is a front end view of the receptacle terminal of FIGS. 3, 4, 6 and 7.

Referring to the Figures, and particularly FIG. 1, there is illustrated an electrical connector system 10 comprising a pin terminal connector assembly 11 and a receptacle terminal connector assembly 12. The system 10 is intended for, though not limited to, use in an automobile or similar vehicle. Accordingly, the system is relatively small and compact and is designed to resist the often hostile environment. The pin terminal connector 11 includes one or more, in this instance four, pin terminals 15, or simply pins, adapted for insertion into mated electrical engagement with respective receptacle terminals in the receptacle terminal connector 12. The pins 15 may be spaced 0.10 inch or more on centers and have a principal cross-sectional dimension of 0.025 inch. In the illustrated embodiment the pins 15 are of rectangular or square cross section, but they might also be round.

Referring to FIG. 2, the receptacle terminal connector assembly 12, or simply receptacle connector, is illustrated in greater detail. Receptacle connector 12 includes a connector housing 14, a multi-channeled terminal holder 16, and four receptacle terminals 18, only one being illustrated in this Figure. A face or end seal 20 is also depicted in connector housing 14 to aid in providing a sealed environment. Additional sealing members, not shown in FIG. 2, may also be provided as will be described hereinafter in greater detail.

Referring to FIGS. 3–11, there is depicted a novel arrangement for a receptacle terminal 18. Referring specifically to FIG. 5, receptacle terminal 18 is formed from a suitably-conductive sheet metal blank 22 by conventional stamping and bending techniques. The intermediate form, designated 18*a* in FIG. 5, represents the terminal 18 following most or all of the stamping operation and prior to bending into the final form, designated 18. The terminal 18 has a longitudinal body 23 for receiving a pin terminal 15 as in FIGS. 1 and 11. The body 23 of terminal 18 is rectangular or square in cross section transverse to its longitudinal axis, though it will be understood that other geometries including circular might similarly apply. The terminal body 23 includes a top wall 24, an opposing bottom wall 26 and a pair of opposed, connecting side walls 27 and 28 which define an interior cavity 29. One of the walls, in this instance upper wall 24, is provided with one or more longitudinal bosses or ribs 30 extending relatively into the cavity 29. In the illustrated embodiment, the upper wall 24 of terminal body 23 is formed by folding a pair of elongated tabs 24*a* and 24*b* into opposing and substantially abutting relation. Each half of the rib 30 is formed by a respective rib-half 30*a* and 30*b*. Each of the rib halves 30*a* and 30*b* is formed by an extrusion or stamping process which creates an upset in the metal of the terminal. Each of the rib halves 30*a* and 30*b* preferably includes a flat surface at its innermost extreme such that the rib 30 correspondingly includes a flat surface for increased area in contact with the pin terminal 15.

Opposing the rib 30 is a spring arrangement, generally designated 32, for electrically contacting and resiliently supporting a pin terminal 15. More specifically, a beam spring 32 extends rearwardly into the cavity 29 from the front end of the terminal body 23 and is longitudinally divided or bifurcated from its distal end forwardly by a slit 33 to provide a pair of spring arms 32*a* and 32*b*. Spring arms 32*a* and 32*b* are generally of convex shape such that their midportions extend upwardly into cavity 29 a greater distance than their respective end portions. More particularly, the opposite ends of the spring arms 32*a* and 32*b* are in engagement with the bottom wall 26, with the proximal or forward end of each spring being formed as an integral portion of the terminal body 23. Additionally, each of the spring arms 32*a* and 32*b* includes a respective flange 34*a* and 34*b* along its midportion. The flanges 34*a* and 34*b* extend laterally outward from the outer edges of the respective spring arms 32*a* and 32*b* and are curved upwardly and inwardly to present a pair of spaced, substantially opposing, longitudinally-extending end surfaces 34*a*′ and 34*b*′.

Figure 11:
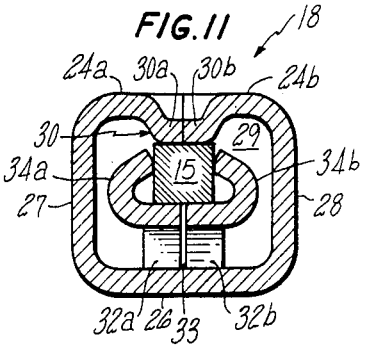
FIG. 11 is a sectional view of the terminal of FIG. 7 taken along line 11—11 thereof.

Because spring arms 32*a* and 32*b* are separate at least along the region in which they are inwardly bowed to the greatest extent into the cavity 29, each may act independently to resiliently urge an inserted pin terminal 15 (as illustrated in FIG. 11) into engagement with the longitudinal rib 30 formed in the upper wall 24. Such arrangement has the advantage of enhancing and ensuring opposing contact between the rib 30 and at least one or the other of the beam spring arms 32*a* and 32*b* in the event the terminal 18 is subjected to shock or vibration. Even further, the flanges 34*a* and 34*b* on the respective spring arms 32*a* and 32*b* are contoured and dimensioned such that their end faces 34a' and 34b' resiliently engage opposite faces of the pin terminal 15, generally in quadrature with the regions of contact provided by the spring arms 32a, 32b and the rib 30. The normal spacing between the opposed faces 34a' and 34b' of the flanges 34a and 34b prior to insertion of a pin terminal 15 is slightly less than the width of the pin terminal. To facilitate the lead-in of a pin terminal 15 into the space between flanges 34a and 34b, the forward edges of those flanges are rearwardly inclined at 35a and 35b respectively. Each of the spring arms 32a and 32b is sufficiently long, narrow and thin, being about 0.190, 0.012, and 0.008 inch, respectively, that when a pin terminal 15 is inserted between flanges 34a and 34b, the spring arms are resiliently flexed and relatively spaced in a lateral direction as shown in FIG. 11. This insures that the flanges 34a and 34b resiliently engage pin terminal 15 and that each of the spring arms operates relatively independent of the other. Such arrangement provides multidirectional stability to the contact between the pin terminal 15 and the receptacle terminal 18. Each of the surfaces of receptacle terminal 18 which engages the pin terminal 15 typically is of significant longitudinal extent thereby to provide both stability and to increase the area of mechanical and electrical contact. This has the advantage of minimizing localized wear spots and the high resistance paths associated with very small areas of contact.

Referring to FIG. 11 in which a pin terminal 15 is shown inserted into a receptacle terminal 18, it will be noted that both electrical contact and support are provided to the pin terminal by at least five distinct regions of the terminal 18. Specifically, the upper surface of each of the two spring arms 32a and 32b provides such support and contact surfaces, the opposing end faces 34a' and 34b' of the flanges 34a and 34b provides another two such support and contact surfaces and the longitudinal rib 30 provides a fifth such surface.

With respect to the support and contact surface provided by the rib 30, it should be understood that although the spring arms 32a and 32b are sufficiently independent and resilient to provide independent support surfaces, a much larger area of material is employed in forming the tabs 24a and 24b which combine to form the upper wall 24 and, accordingly, the rib 30 is much less resilient. In fact, rib 30 may be viewed as being a relatively rigid, elongated contact surface. It is generally preferable to form the upper wall tabs 24a and 24b in contacting relation along their longitudinal seam for preserving the structural integrity of the terminal and minimizing openings through which the pin terminal 15 might be deflected.

However, in the event it is permissible or desirable to provide a small space between the upper wall tabs 24a and 24b, the rib portions 30a and 30b formed along the edges of the respective wall tabs will each define separate longitudinal ribs spaced a small distance from one another and thus provide an additional, or sixth, region of contact between terminal 18 and pin terminal 15. Should it be desirable to have two spaced ribs, such as rib halves 30a and 30b, yet also to maintain the wall tabs 24a and 24b in contacting relation, each of the rib segments 30a and 30b might be formed relatively more toward the adjacent wall portions 27 and 28 and each define 180° curved surfaces.

Referring to FIG. 5, and particularly to the terminal blank 18a therein, it will be noted that the spring member 32 is formed and bifurcated to provide the separate spring arms 32a and 32b. Additionally, the forward end of the partially-shaped terminal blank has longitudinally pierced slots extending for a short distance at each of four positions 40. The slot positions 40 correspond with the four corners of the resulting receptacle terminal 18. More specifically, as more clearly seen in FIGS. 3, 4 and 8–10, the slot positions 40 enable the short wall flaps therebetween to be folded inward and rearward at substantially 180°. This strengthens the forward end of terminal 18 and importantly also results in its forward end face being inwardly tapered by the curvature of the bend, which thus aids in directing a pin terminal 14 into alignment with the interior cavity 29 and the several contacting surfaces provided by spring arms 34a, 34b, flange surfaces 34a' and 34b' and the rib 30. Moreover, the forward end of the receptacle terminal 18 is also thus seen to provide a continuous closed surface for preventing inadvertent misalignment or misdirection of a skewed pin terminal 15 during insertion.

Rearwardly of the spring 32 in the body portion 23 of receptacle terminal 18 there is additionally provided at least one, and preferably two openings, 42, each provided through a respective different one of the walls thereof for securing the terminal 18 in position within terminal holder 16, as will be hereinafter described in greater detail. The openings 42 are preferably formed through the bottom wall 26 and the top wall 24, are opposite one another and have the same geometry and dimensioning. More specifically, the openings 42 may typically be rectangular and slightly elongated along the longitudinal axis of the receptacle terminal 18.

Rearwardly of the main terminal body 23, the receptacle terminal 18 also includes structure for gripping a conductor wire 44 in a conventional manner, as depicted in FIGS. 2 and 21. As used herein, the phrase 'conductor wire' is intended to mean not only an electrical conductor but also any insulation which might surround that conductor. More specifically, that gripping structure includes a first pair of jaws 46 which are formed to grippingly engage insulation on the conductor wire 44 and a second pair of jaws 48 which are in good electrical and mechanical contact with the electrically conductive center core of the conductor wire 44. Instead of the configuration of jaws 46 and 48 as depicted in the illustrated embodiment, it will be understood that other arrangements are similarly applicable for gripping a conductor wire 44. For instance, any of several suitable insulation-displacing connector designs (IDC) might be used if it is desired to both grip the insulation and engage the conductive core of the conductor wire 44 without additional preparation of that wire.

Referring to FIGS. 2, 12–15 and 21, the structure and function of the terminal holder 16 will be considered in greater detail. The terminal holder 16 is preferably rigid and formed of injection-molded plastic. The terminal-receiving portion of the terminal holder 16 includes a base 50 for generally supporting the receptacle terminals 18 in substantially coplanar relation with one another and further includes a plurality of longitudinally-extending walls 52 extending upwardly from the support base 50 to define a plurality, (in this instance four) terminal-receiving cavities or channels 54. The height of the walls 52 from base 50 is such that they extend somewhat above the upper surface of the receptacle terminals 18 when seated in the channels 54, as illustrated in FIG. 21. Further, the forward end of the terminal holder 16 is generally closed by a forward end wall 56 which includes four laterally-spaced entry port slots 58 extending downwardly from the top thereof to the support surface of base 50.

At the rear end of the terminal-supporting cavity of terminal holder 16 there are provided shallow, arcuate lands 60 aligned with the respective terminal channels 54 for supporting a portion of the rounded conductor wire 44. Each land 60 includes a small tang 61 for engaging the insulation on a conductor wire 44 to provide strain relief. Extending rearward from the terminal-containing portion of the terminal holder 16 is a relatively thin platform 62 formed integrally therewith and including a series of side-by-side shalow, arcuate channels 64 in the upper surface thereof, laterally aligned with the lands 60 and the terminal-receiving channels 54. The platform 62 and the respective channels 64 therein also serve to support the conductor wires 44 in substantially coplanar relation with one another and additionally to provide a surface for a sealing member as will be hereinafter described in greater detail. The base of each of the arcuate channels 64 is downwardly offset somewhat from the base of the respective arcuate lands 60 in order to accomodate the thickness of the mentioned sealing member. Finally, at the rear end of the terminal holder 16 there is provided a flange 66 affixed to the rear end of platform 62 and disposed transverse to the longitudinal extent of the holder. The width of the flange 66 is greater than that of the remaining portion of the terminal holder 16 and includes a pair of locking tabs 67 on its opposite, outward ends for locking engagement with the connector housing 14. The dimensioning of the flange 66 in the vertical direction is such that it extends both above and below any remaining portion of the terminal holder 16. A series of four side-by-side, longitudinally-extending slots 68 extend downwardly into the flange 66 and are provided with arcuate bases for supporting the respective conductive wires 44 substantially in registry with the arcuate support surfaces 60. A pair of small tangs 69 exist in each of the slots 68 for engaging the insulation on conductor wire 44 to provide strain relief.

Referring to FIGS. 2, 4 and 12–15, the receptacle terminals 18 are securely retained within the respective channels 54 of terminal holder 16 by a novel locking arrangement in which a pair of snap-lock fingers 70*a* and 70*b* are in locking engagement with a respective terminal 18 through a corresponding one of the openings 42 therein. Each of the terminal-receiving channels 54 of the terminal holder 16 is provided with a respective pair of snap-lock fingers 70*a* and 70*b* extending upwardly from the surface of the base support member 50. The snap-lock fingers 70*a* and 70*b* are formed integrally with the remainder of the body of terminal holder 16 and are of such geometry and dimensioning as to afford at least a limited degree of resilience to allow locking engagement with a respective terminal 18, and preferably also to permit unlocking therefrom. The snap lock fingers 70*a* and 70*b* are oriented in 'V'-shape fashion relative to one another and, in the illustrated embodiment, are relatively longitudinally displaced in a respective terminal channel 54. It will be appreciated that other orientations, as for instance transverse to channel 54, might similarly be applicable.

Each of the snap-lock fingers 70*a*, 70*b* is provided with a respective camming surface 71*a*, 71*b* on a respective longitudinally-outward surface thereof for facilitating the relative introduction of the snap-lock fingers into a corresponding opening 42 in a terminal 18. The dimensioning of the snap-lock fingers 70*a*, 70*b* and the amplitudes or lengths of the respective camming surfaces 71*a*, 71*b* are such that the respective camming surfaces are engaged by the edges of bottom wall member 26 which define the opening 42 in the terminal 18. The terminal 18 may then be moved relatively toward the base surface 50 of the terminal holder 16 to relatively insert the snap-lock fingers 70*a*, 70*b* through the opening 42. The camming surfaces 71*a*, 71*b*, of the respective snap-lock fingers 70*a*, 70*b*, extend outward from the center of the respective fingers a sufficient distance to extend beyond the perimeter of the opening 42 in the terminal 18. That outer surface of each of the snap-lock fingers 70*a*, 70*b*, is then contoured or recurved relatively inwardly to provide respective lobes 72*a*, 72*b* and respective recesses 73*a*, 73*b*. Following insertion of the snap-lock fingers 70*a*, 70*b* through the opening 42 of terminal 18, the lobes 72*a*, 72*b* flex outwardly to extend beyond the perimeter of the opening 42 and a portion of the base wall 26 of the terminal 18 is received in the respective recesses 73*a*, 73*b* in the locking fingers. Such arrangement serves to securely retain the terminal 18 in a desired position within its respective channel 54 in the holder 16 and in alignment with a respective entry port 58.

The snap-lock fingers 70*a* and 70*b* are sufficiently resilient as to permit subsequent removal of a terminal 18 from locked engagement therewith as by applying a relative lifting force to the terminal, typically, via its rearward end and/or the conductor wire 44. It will be understood that by providing a plurality of mounting opening 42 in a respective terminal 18, that terminal might be mounted and locked in a corresponding plurality of orientations about its longitudinal axis. Moreover, it will be understood that a terminal holder might be provided having terminals locked in respective channels on opposite sides of a common base member to provide two rows of terminals.

Figure 16:
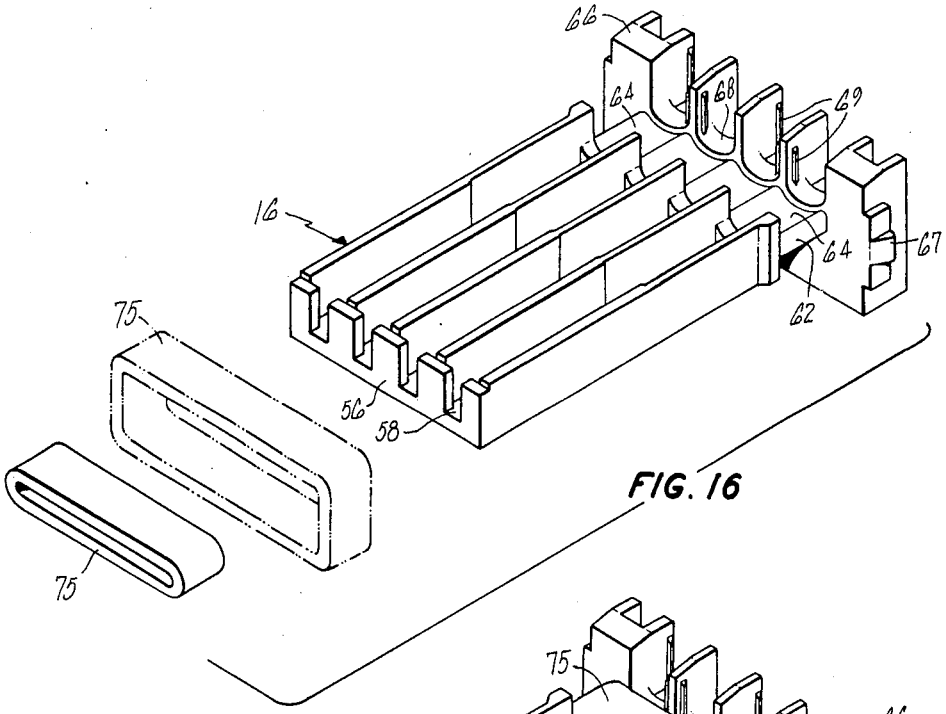
FIG. 16 is an exploded view of the terminal holder and a first seal therefor prior to installation.
Figure 17:
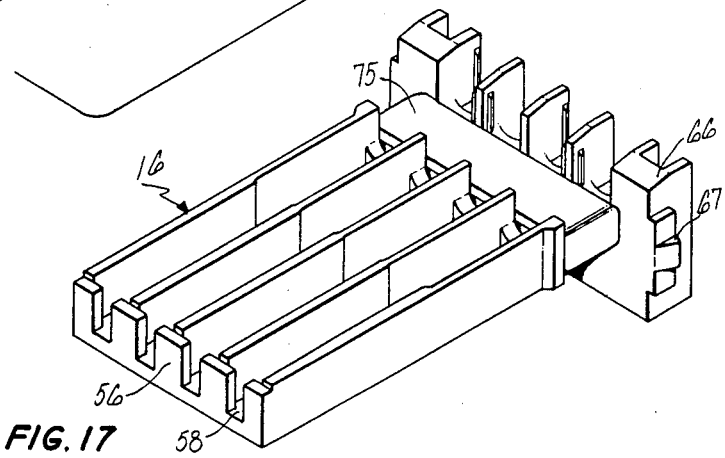
FIG. 17 depicts the terminal holder of FIG. 16 following installation of the first seal.

The terminal holder 16 and corresponding receptacle terminals 18 may be housed in connector housing 14 in a manner providing a connector assembly 12 which is relatively sealed against moisture and other elements likely to be encountered in the environment of an automobile or similar vehicle. Specifically, referring to FIGS. 16–22, a novel sealing arrangement is provided for creating a seal at the interface between terminals 18 and/or conductors 44 joined thereto, and both the terminal holder 16 and the connector housing 14. Referring to FIGS. 16 and 17, there is depicted a first, or inner, sealing member 75 formed as a continuous annular band of resilient material. Inner seal 75 is preferably formed of fluorosilicone having about 40 Shore A durometer which provides the desired resiliency and is additionally resistant to the various fluids which might be encountered in an automotive enviroment. The resiliency of the inner seal 75 is required both to provide a necessary sealing action and additionally to accommodate temporary expansion of the annular band during its mounting in an operative position. In fact, the inner seal 75 is manually or automatically expanded as shown in dotted line in FIG. 16 such that the terminal holder 16 may be relatively inserted therethrough until the seal is aligned with the platform 62 containing the shallow arcuate channels 64. In such position, the force for temporarily expanding the inner seal 75 is released and the seal is allowed to return toward its original geometry. Preferably the relative sizes of the inner seal 75 and the terminal holder platform 62 are such that the sealing member remains in tensile stress as depicted in FIG. 17. Thereafter, the receptacle terminals 18 with respective conductive wires 44 joined thereto may be mounted in the terminal holder 18 through locking engagement with the snap-lock fingers 70a, 70b. Such mounting of the terminals 18 causes the conductor wires 44 to pass over the outer surface of the inner seal 75 and to at least partly depress that seal into the shallow arcuate channels 64 of the terminal holder platform 62, as illustrated by the rightmost conductor 44 in FIG. 21.

A second, or outer, seal 80, depicted in detail in FIGS. 18–20, is also of continuous, generally annular configuration and is disposed about the terminal holder 16 and the conductor wires 44, radially outward of both. Outer seal 80 is typically formed of the same material as the inner seal 75. Unlike the inner seal 75 which typically has a relatively plain shape defined by parallel inner and outer surfaces, the outer seal 80 has a relatively more complex geometry. The outer surface of outer seal 80 is inwardly tapered in the forward direction and includes a pair of bosses or ribs 81 and 82 extending around its circumference. Ribs 81 and 82 are longitudinally spaced from one another, with rib 81 being adjacent the forward end of outer seal 80 and rib 82 being near the rear end of that seal. The ribs 81 and 82 are of similar size such that rib 82 projects radially outward a greater distance than does rib 81.

The interior surface of outer seal 80 is contoured to a provide a large central opening 84 through which part of the terminal holder 16, the inner seal 75 and the conductor wires 44 may pass. That interior surface is generally contoured to provide an oblong opening 84 such that it smoothly and tightly engages the outer surface of the inner seal 75 in their regions of mutual contact both below and transversely outward of the terminal holder 16. However, in the region where outer seal 80 passes over the conductor wires 44, its inner surface provides a series of arcuately-contoured, longitudinally-extending slots 85 are in alignment with the respective terminal holder channels 54, and thus also the respective conductive wires 44, so as to closely embrace the upper portion, typically the upper half, of those conductor wires. More specifically, a further pair of bosses, or ribs, 86 and 87 are provided in the arcuate slots 85 on the inner surface of sealing member 80. The ribs 86 and 87 extend arcuately across the slots 85 with a radius which approximates that of the conductor wire 44 and are longitudinally spaced from one another, with rib 86 being relatively forward of rib 87. Unlike the outer surface of outer seal 80, its inner surface is not tapered.

The outer seal 80 is operatively positioned about the terminal holder 16, the inner seal 75 and conductor wires 44 by relatively inserting the terminal holder forwardly through the outer seal. The dimensioning of the outer seal 80 and the central opening 84 therein is such as to lightly tension that seal when it is mounted. Such tension on the outer seal 80 ensures a good sealing contact between its interior ribs 86 and 87 and the surfaces of conductor wires 44, and also between the remainder of its interior surface and the outer surface of the inner seal 75. Additionally, the outer seal 80 serves to press the conductor wires 44 downward into good sealing engagement with the inner seal 75 and such that those conductor wires in turn press the inner seal 75 into good sealing engagement with the upper surface of terminal holder platform 62.

Referring to FIGS. 1, 2 and 22, the connector housing 14 of assembly 12 is formed of molded plastic and includes an interior cavity 90 for receiving the subassembly shown in FIG. 21 consisting of the terminal holder 16, associated terminals 18 and the inner and outer seals 75 and 80, respectively. The connector housing 14 provides a substantially-continuous closure about the terminal holder 16 except for a plurality of entry ports 92 extending through its front end wall and for the relatively large opening at the rear thereof for allowing entry of the terminal holder and associated conductor wires 44.

The entry ports 92 in connector housing 14 are aligned with the entry ports 58 in the terminal holder 16 and with the opening in the forward end of the respective receptacle terminal 18. The cross-sectional geometry of the entry port 92 is substantially the same as that of the pin terminal 15 and is sized to allow entry of the pin terminal with relatively little additional clearance for the entry of fluids or dirt. The forward end of the entry port 92 may be tapered to facilitate the entry of a pin terminal 15. A resilient face seal 20, typically of the same material as the inner and outer seals 75 and 80, is positioned intermediate the forward end of the terminal holder 16 and the interior surface of the forward end of housing 14. The face seal 20 may typically be a rectangular strip having appropriate openings 94 therethrough in alignment with the entry ports 92 in housing 14 and the entry mouths in the forward end of the respective receptacle terminal 18. The openings 94 in face seal 20 are cross-sectionally smaller than the pin terminals 15 of connector 11 such that they sealingly embrace the outer periphery of those pin terminals when they are operatively inserted into mated engagement with the corresponding receptacle terminal 18.

The rear portion of connector housing 14 is transversely enlarged to accommodate the correspondingly enlarged rear portion of the terminal holder 16 with the inner and outer seal 75 and 80 mounted thereon. Additionally, the rear portion of the connector housing 14 is provided with a pair of conventional locking flanges, or arms, 95 at opposite sides thereof for engaging the lock tabs 67 on the terminal holder 16 when the terminal holder 16 is fully inserted thereinto. The locking arms 95 on housing 14 and the lock tabs 67 on terminal holder 16 are relatively positioned such that the two elements enter into locked engagement only when the terminal holder is inserted sufficiently forward in the housing as to press the face seal 20 into mutual sealing engagement with the interior surface of the forward end of the connector housing 14 and with the forward end of the terminal holder 16. The terminal holder 16 is maintained in this position when the locking arms 95 and lock tabs 67 are in their conventional locked orientation. In the event a terminal holder is used having rows of terminals mounted on opposite sides of a common base member, a similar sealing arrangement may be used but it will be understood that then both the upper and lower interior surfaces of the outer sealing ring will require slots 85.

With the terminal holder 16 fully loaded and locked into the connector housing 14, as illustrated in FIG. 22, the geometry of the interior surface of the housing toward its rearward end in the region of the outer seal 80 substantially parallels that of the seal and the two are in close continuous sealed engagement via contact between the seal ribs 81 and 82 and the interior surface of the housing. Thus it will be noted that the novel arrangement of an inner seal 75 and an outer seal 80 serving in cooperative relation with the terminal holder 16, the conductor wires 44 and the interior surface of housing 14 provide a substantially fluid-tight closure to the rear opening of the connector housing. Additionally, although the small openings 94 in the face seal 20 may afford some entry to the connector assembly 12 prior to mated insertion with a pin terminal 15, it usually is not of great concern since the connector is then under a controlled environment during manufacture and assembly in a vehicle. However, once pin terminal connector 11 is connected in mated assembly with the receptacle connector assembly 12, the environment in the region of electrical and mechanical connection between the respective terminals is substantially completely sealed.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to secure by Letters Patent of the United States is:

1. An improved electrical receptacle terminal having a longitudinal body for receiving an electrical pin terminal, spring means secured to the body and extending longitudinally therein and the direction of insertion of the pin terminal and being disposed for urging the pin terminal into contact with a part of the body, the improvement comprising:

said body including first and second opposing wall regions, a pair of opposing side walls connecting said first and second opposing wall regions, said body being of generally rectangular configuration in cross section transverse to its longitudinal extent, the forward ends of said first wall region and said pair of side walls being folded in and rearward and said spring means being integrally joined at only one end to said body and comprising a forward extension of said second wall which is also folded in and rearward at said one end of said spring means thereby to cumulatively define a substantially continuous entry aperture at the front of said receptacle body;

longitudinal rib means extending inwardly from said first wall region; and the spring means being intermediate said rib means and said second wall region and being split longitudinally from the other end thereof for at least part of its length to bifurcate said spring means and provide first and second relatively independent spring arms, a region of said spring means remote from said one end being normally in engagement with said second wall region prior to insertion of the pin terminal, and said first and second spring arms opposing said longitudinal rib means for receiving the inserted terminal pin therebetween and for independently and cooperatively contacting and urging the terminal pin into contact with the longitudinal rib.

2. The receptacle terminal of claim 1 wherein said entry aperture to said body is inwardly inclined at its forward end to facilitate entry of the terminal pin.

3. The receptacle terminal of cliam 1 wherein said first and second spring arms include first and second flanges extending therefrom respectively, the first and second flanges being contoured to provide respective, substantially opposing surfaces for receiving the inserted terminal pin therebetween in mutual contact therewith.

4. The receptacle terminal of claim 3 wherein each of said first and second spring arm flanges extends transversely from a laterally-outer edge of the respective said spring arm and is reversely curved to provide said opposing surface for contacting the inserted terminal pin.

5. The receptacle terminal of claim 3 wherein the spacing between said opposing surfaces of said first and second flanges is less than the width of said pin terminal so that said flanges resiliently engage said pin terminal.

6. The receptacle terminal of claim 1 wherein said first wall region is formed by a pair of tabs in opposed relation and wherein said rib means comprises a respective longitudinal rib formed along the edge of each of said tabs.

7. The receptacle terminal of claim 6 wherein the tabs of said first wall region are structured so as to be relatively rigid.

8. The receptacle terminal of claim 6 wherein said terminal body is formed of metal and said longitudinal rib in each of said tabs is formed by an upset in the metal.

* * * * *